US009647405B2

(12) United States Patent
Yamamoto

(10) Patent No.: US 9,647,405 B2
(45) Date of Patent: May 9, 2017

(54) METHOD OF MACHINING A FLAT HARNESS USING A PUNCHING MACHINE

(75) Inventor: Masataka Yamamoto, Toyota (JP)

(73) Assignee: YAZAKI CORPORATION, Tokyo (JP)

( * ) Notice: Subject to any disclaimer, the term of this patent is extended or adjusted under 35 U.S.C. 154(b) by 1220 days.

(21) Appl. No.: 11/386,815

(22) Filed: Mar. 23, 2006

(65) Prior Publication Data

US 2006/0213344 A1 Sep. 28, 2006

(30) Foreign Application Priority Data

Mar. 23, 2005 (JP) ..... P2005-083760

(51) Int. Cl.

| | |
|---|---|
| ***B21D 28/26*** | (2006.01) |
| ***H01B 13/012*** | (2006.01) |
| ***H01R 13/64*** | (2006.01) |
| ***H01R 43/28*** | (2006.01) |

(52) U.S. Cl.

CPC ..... *H01R 43/28* (2013.01); *B21D 28/26* (2013.01); *B21D 28/265* (2013.01); *H01B 13/012* (2013.01); *H01R 13/64* (2013.01); *Y10S 83/947* (2013.01); *Y10T 29/49995* (2015.01); *Y10T 83/0524* (2015.04); *Y10T 83/0572* (2015.04); *Y10T 83/943* (2015.04); *Y10T 83/944* (2015.04)

(58) Field of Classification Search

CPC ..... H01R 43/28; H01R 13/64; B21D 28/246; B21D 28/26; B21D 28/265; B23D 27/00; H01B 13/00; H01B 13/012; Y10S 83/916; Y10S 83/947; Y10T 83/0524; Y10T 83/0529; Y10T 83/0534; Y10T 83/0572; Y10T 83/943; Y10T 83/944; Y10T 29/49995

USPC ..... 83/49, 916, 41, 39, 40, 687, 691, 947; 29/557

See application file for complete search history.

(56) References Cited

U.S. PATENT DOCUMENTS

| | | | | |
|---|---|---|---|---|
| 2,308,277 | A * | 1/1943 | Gillen | 83/50 |
| 2,690,802 | A * | 10/1954 | Russell | 83/23 |
| 4,998,430 | A * | 3/1991 | Howe | 72/335 |
| 5,400,682 | A * | 3/1995 | Matsuura | 83/49 |
| 7,249,546 | B1 * | 7/2007 | Fosnaugh | 83/50 |
| 2002/0020545 | A1 | 2/2002 | Suzuki | |

FOREIGN PATENT DOCUMENTS

| | | | |
|---|---|---|---|
| GB | 2 265 110 | A | 9/1993 |
| JP | 6-77116 | U | 10/1994 |
| JP | 06-333443 | A | 12/1994 |
| JP | 2003297517 | A | 10/2003 |
| JP | 2004006218 | A | 1/2004 |
| JP | 2004-139941 | A | 5/2004 |

OTHER PUBLICATIONS

Japanese Abstract of 2002231064, dated Aug. 16, 2002.
European Search Report dated Jun. 5, 2012, issued in counterpart European Patent Application No. 06005904.5.

* cited by examiner

*Primary Examiner* — Clark F Dexter
(74) *Attorney, Agent, or Firm* — Sughrue Mion, PLLC

(57) ABSTRACT

A flat harness is machined by providing a punching machine that includes a first punching device and a second device, and forming different types of hole portions in the shape on the insulating portion of the flat harness in a die cutting process by using the first punching device and the second punching device.

6 Claims, 7 Drawing Sheets

PRIOR ART

PRIOR ART

PRIOR ART

PRIOR ART

METHOD OF MACHINING A FLAT HARNESS USING A PUNCHING MACHINE

BACKGROUND OF THE INVENTION

The present invention relates to a flat harness machining method of forming a plurality of hole portions in insulating coupling plate portions of a flat wire harness, which has a plurality of conductor portions in parallel, by a device cutting using a press and a punching machine.

FIG. 6 and FIG. 7 show a mode of a flat harness machining method in the related art (see JP-A-6-333443 (FIG. 1 and FIG. 2)).

While using the punching machine 45 having upper punches 41, 42, 43, a lower movable device 44, and the like, as shown in FIG. 6, this flat harness machining method forms simultaneously a longitudinal slit 47, a round hole 48 at an end of the slit 47, a rectangular notched portion 49 adjacent subsequently to the slit 47 in a flat harness 46 with one stroke, as shown in FIG. 7. The round hole punch 43 and the notching punch 42 are projected downward farther than the slit punch 41, so that the round hole 48 and the notched portion 49 are formed first and then the slit 47 is formed.

The flat harness 46 is constructed to have a plurality of conductor portions (not shown) such as print circuits, or the like in parallel with the slit 47 and to cover respective conductor portions with a flexible insulating sheet. The slit 47 is formed to bend or branch-connect the flat harness 46. The round hole 48 is formed to prevent a cutting of the slit 47 from extending. The notched portion 49 is formed to differentiate a length of an end portion of the flat harness 46, or the like.

FIG. 8 shows a mode of a flat harness fitting method in the related art (see JP-A-2004-139941 (FIG. 5)).

A flat harness 50 has slit-like hole portions 53 and positioning hole portions 56 in parallel with insulating coupling plate portions 58 provided between conductor portions 57 respectively. Press-fitting terminals 52 of a connector 51 are passed through these hole portions 53. The positioning hole portions 56 are engaged with rectangular positioning projections 55 of a car body or an onboard equipment 54. The conductor portions 57 are constructed by a core wire made of conductive metal and have a round sectional shape.

The flat harness 50 is provided on the car body or the onboard equipment 54 in a state that the conductor portions 57 are pressure-welded to the press-fitting terminals 52. The press-fitting terminal 52 has a pair of right and left press-fitting pieces (both indicated with a symbol 52 herein) and a slot which is formed between a pair of press-fitting pieces and into which the conductor portion 57 is press-fitted. Also, an insulating cover cutting blade is provided to inlets of a pair of press-fitting pieces respectively.

FIG. 9 and FIG. 10 show a mode of a flat harness connector manufacturing method in the related art (see JP-A-2003-297517 (FIG. 2, FIG. 8)).

A flat harness connector 59 is constructed such that two sheets of flat harnesses 60, 61 are arranged orthogonally to each other, then respective conductor portions of both flat harnesses 60, 61 are connected mutually via joint terminals 63 of a joint connector 62, and then a connector 68 is provided to terminals of the flat harnesses 60, 61 respectively.

As shown in FIG. 9, in respective flat harnesses 60, 61, a slit 66 is provided to an insulating coupling plate portion 65 between conductor portions 64. Because lengths of the slits 66 are set differently, the reverse fitting of the flat harness onto a press-fitting unit (not shown) is prevented. A round positioning hole 67 is provided to one flat harness 60 adjacent to the slit 66 in the longitudinal direction.

A setting jig (not shown) of the press-fitting unit has ribs that are engaged with the slits 66 of the flat harnesses 60, 61, and a positioning pin that is engaged with the round hole 67 on one flat harness 60. The joint connector 62 shown in FIG. 10 is fitted in a state that the flat harnesses 60, 61 are positioned in the setting jig to intersect orthogonally with each other, and then press-fitting blades (not shown) push downward the conductor portions 64 between the ribs against press-fitting portions 69 of the lower joint terminals 63, so that both flat harnesses 60, 61 are joined via the joint terminals 63. The joint terminal 63 has the press-fitting portions 69 on both side of the base portion, and is provided to the inside of the joint connector 62. The conductor portions 64 are press-connected to the press-fitting portions 69 between the slits 66 of the joint connector 62 by a falling action of the press-fitting portions 69.

FIG. 11 shows other mode of the flat harness in the related art (see JP-UM-A-6-77116 (FIG. 4)).

A flat harness 70 is constructed such that slits 73 the lengths of which are differentiated sequentially are formed in insulating coupling plate portions 72 between respective conductor portions 71. Since the flat harness 70 is pushed from the shorter side to the longer side of the slits 73 to set upright and pile up the covered conductor portions 71, such flat harness 70 can be bent at any angle and used. A bended portion 74 is bound together with a fastening clip with a strap, for example, and fixed to a hole portion of the car body, or the like.

However, in respective modes in the related art, it is feared that, for example, the worker confuses the hole portions 53 through which the press-fitting terminals 52 are passed with the positioning hole portions 56 when the harness positioning hole portions 56 are small in the flat harness 50 in FIG. 8, or the worker confuses the slits 66 that are engaged with the ribs of the press-fitting setting jig with the positioning round hole 67 when the harness positioning round hole 67 is large in the flat harnesses 60, 61 in FIG. 9, or the worker confuses the bending slits 73 with the positioning hole portion when the large harness positioning hole portion (not shown) is provided in the flat harness 70 in FIG. 11.

Also, in the machining methods of the flat harnesses 50,flat harnesses 50, 60, flat harnesses 50,60,61, flat harnesses 50,60,61,70, since the longer slits 66 that are engaged with the ribs of the press-fitting setting jig to position, the circular round hole 67 for preventing the harness reverse setting in the setting jig, the hole portions 53 for passing the press-fitting terminals, the shorter hole portions 56 for positioning the harness on the car body, the onboard equipment, or the like, and the longer slits 73 used to bend the flat harness must be opened, there are such problems that the dedicated punching device is needed respectively and thus a production cost, a management cost, and the like of the punching devices are increased. Also, when respective holes should be formed in one flat harness, there are such problems that a size and a cost of the punching machine including the punching deices are increased and also the setup operations such as exchange of the punching device , and the like becomes complicated.

SUMMARY OF THE INVENTION

In view of the above problems, it is an object of the present invention to provide a flat harness machining method capable of forming hole portions having various profiles in a flat harness effectively and simply without fail by a die cutting in response to purposes and a punching machine.

It is therefore an object of the present invention to provide a method of Machining a flat harness, the flat harness including a plurality of conductor portions and an insulating portion arranged between the conductor portions, the method comprising:

providing a punching machine that includes a first punching device and a second punching device; and forming different types of hole portions in the shape on the insulating portion of the flat harness in a device cutting process by using the first punching device and the second punching device.

According to the above configuration, two types of different hole portions are formed sequentially or simultaneously in the longitudinal direction of one flat harness by the first punching device and the second punching device in one punching machine. Each of the punching devices consists of a punch and a device. The first hole portion acts as a positioning hole that is engaged with the ribs of the setting jig when the flat harness is set in the setting jig of the press-fitting unit, for example, and the second hole portion acts as a positioning hole that is engaged with the projections on the car body, the onboard equipment, or the like when the flat harness is fitted onto the car body, the onboard equipment, or the like, for example. In this case, preferably the first hole portion should be formed as a longer shape and the second hole portion should be formed as a shorter shape. In respect of preventing the reversed fitting of the flat harness to the setting jig, it is preferable that the first hole portion should be provided in respective insulating portions in the first row and the second row so as to displace in the longitudinal direction.

As described above, according to the above configuration, at least two types of hole portions used for the different purpose can be formed effectively in the flat harness by one punching machine. Therefore, neither a plurality of punching machines should be arranged every different type of hole portion nor the flat harness should be fed sequentially to respective punching machines, so that a machining efficiency (productivity) of the flat harness can be improved.

Preferably, the first punching device has two types of punches. Different types of two hole portions in the shape are simultaneously formed in the device cutting process by using the two types of punches of the first punching device.

According to the above configuration, two types of different hole portions (the first hole portion and the third hole portion) are simultaneously punched and formed adjacently in parallel with one stroke of the first punching device. The third hole portion acts as a positioning hole to prevent such a situation that the flat harness is set front side back when the flat harness is set in the setting jig of the press-fitting unit, for example. In this case, the third hole portion is formed small.

Further, two types of different hole portions (the first hole portion and the third hole portion) can be formed simultaneously with one stroke of the first punching device , and three types of hole portions having different purposes respectively can be formed effectively by using the second punching device together with the first punching device. Therefore, the advantage of the invention can be advanced.

Preferably, the forming process includes: forming a first hole portion by the first punching device; and then forming a second hole portion by the second punching device so as to communicate with the first hole portion such that a longer hole portion is formed.

According to the above configuration, the first hole portion and the second hole portion are integrated together and thus the longer secondary hole portion is constructed. The secondary hole portion acts as a hole portion at which the flat harness is bent in the plate width direction after the secondary hole portion is formed in parallel in the insulating portions in respective rows of the flat harness, for example. In this manner, the hole portion used for the different purpose from the first hole portion and the second hole portion can be formed simply by the same punching machine.

Further, the longer hole portion having a length obtained by adding the first hole portion and the second hole portion can be obtained simply without fail, this longer hole portion can be used for another purpose, and at least the hole portions used for three purposes can be obtained selectively simply by one punching machine. Therefore, the above configuration can respond easily to multiple applications of the flat harness.

Preferably, a hole portion is punched by the second punching device so as to lap over one of the different types of two hole portions such that a longer hole portion is formed.

According to the above configuration, when the third hole portion to be formed by the first punching device is not needed, such third hole portion can be eliminated by the second hole portion that is formed by the second punching device. Therefore, the confusion of the third hole portion with other hole portions cause due to the presence of the unnecessary third hole portion can be prevented. The paragraphs beginninh on page 8,line 9 and ending on page 9,line 6 have been Rewritten as follows:

According to the present invention, there is also provided a punching machine for machining a flat harness, the flat harness including a plurality of conductor portions and an insulating portion arranged between the conductor portions, the punching machine comprising:

a first punching device and a second punching device for forming different types of hole portions in the shape on the insulating portion of the flat harness, wherein the first punching device is different in the shape from the second punching device.

Preferably, the first punching device has two types of punches in the shape.

Preferably, one of the punches of the first punching device is formed in a square pole shape and the other of the punches is formed in a circular cylinder shape. The second punching device has a punch that is formed in the square Pole shape.

Preferably, the one of the punches of the first punching device having the square pole shape is longer than the punch of the second punching device in a longitudinal direction of the flat wire harness.

Preferably, the punching machine further comprises a third punching device and a forth punching device, the third punching device being different in the shape from the fourth punching device. The first punching device and the second punching device are aligned along a first line. The third punching device and the fourth punching device are aligned along a second line which is parallel to the first line. The first punching device and the third punching device are shifted to each other in an extending direction of the first line.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

FIG. 1 to FIG. 4 show a flat harness machining method according to the exemplary embodiments of the present invention.

Figure 1:
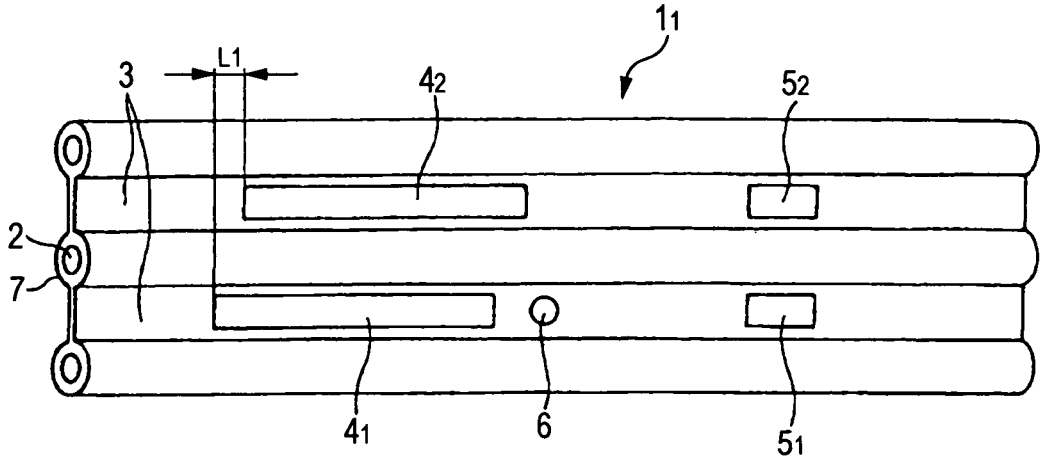
FIG. 1 is a plan view showing a flat harness manufactured by a flat harness machining method according to a first embodiment of the present invention.

In FIG. 1, in a flat harness $\mathbf{1}_1$, a slit-like longer first hole portion 4 ($\mathbf{4}_1$,$\mathbf{4}_2$) and a rectangular shorter second hole portion 5 ($\mathbf{5}_1$,$\mathbf{5}_2$) are provided in an insulating coupling plate portion (insulating portion) 3 in each row between conductor portions 2 in parallel in the harness longitudinal direction respectively. Also, a circular third hole portion 6 is provided between the longer hole portion $\mathbf{4}_1$ and the shorter hole portion $\mathbf{5}_1$ in vicinity of the longer hole portion $\mathbf{4}_1$ in the first row. The conductor portions 2 are covered with an insulating coating 7 made of a synthetic resin or a synthetic rubber, and respective hole portions 4 to 6 are provided to the coupling plate portion 3 that couples integrally respective insulating coatings 7.

When the conductor portions 2 are press-fitted into the press-fitting terminals (not shown), the ribs of the setting jig of the press-fitting unit (not shown) are engaged with the longer hole portions 4 to position the flat harness $\mathbf{1}_1$. Also, the circular hole portion 6 is used to position the flat harness $\mathbf{1}_1$ by inserting the positioning pin of the press-fitting unit when the flat harness $\mathbf{1}_1$ is set to the press-fitting unit. Also, the shorter hole portions 5 are used to position the flat harness $\mathbf{1}_1$ by inserting the projections (not shown) of the vehicle, the onboard equipment, or the like when the flat harness $\mathbf{1}_1$ is provided to the vehicle, the onboard equipment, or the like. In this case, the press-fitting pieces of one or plural press-fitting terminals may be passed through the longer hole portions 4 and the shorter hole portions 5.

Figure 5:
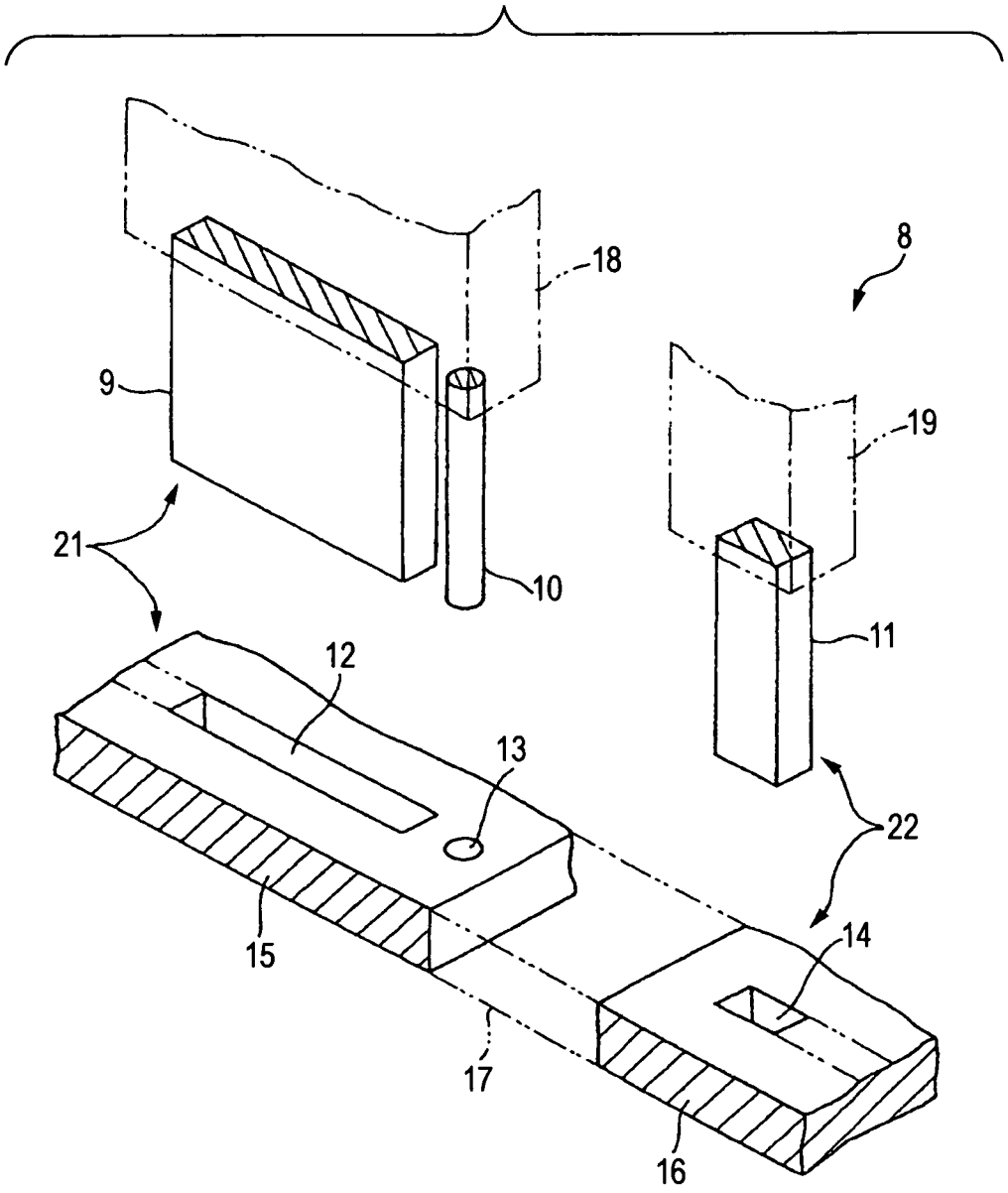
FIG. 5 is a principal perspective view showing a mode of a punching machine used in the flat harness machining method.
Figure 6:
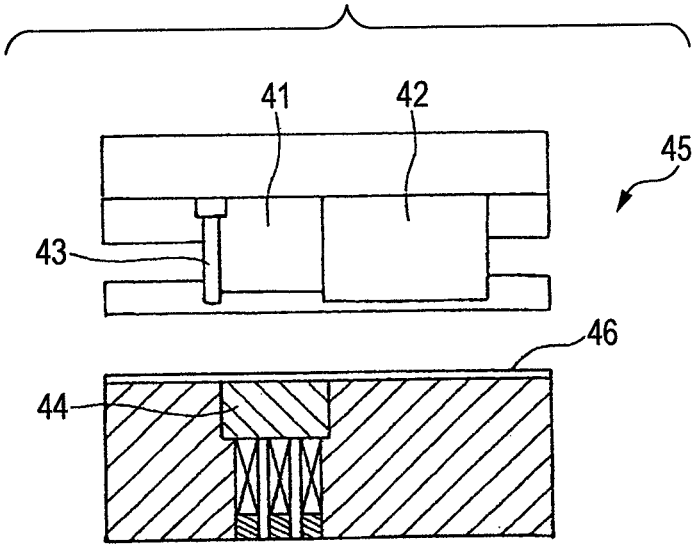
FIG. 6 is a longitudinal sectional view showing a mode of a punching machine used in a flat harness machining method in the prior art.
Figure 7:
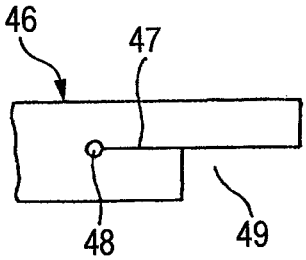
PRIOR ART FIG. 7
FIG. 7 is a plan view showing a principal portion of the flat harness formed by the flat harness machining method in the prior art.
Figure 8:
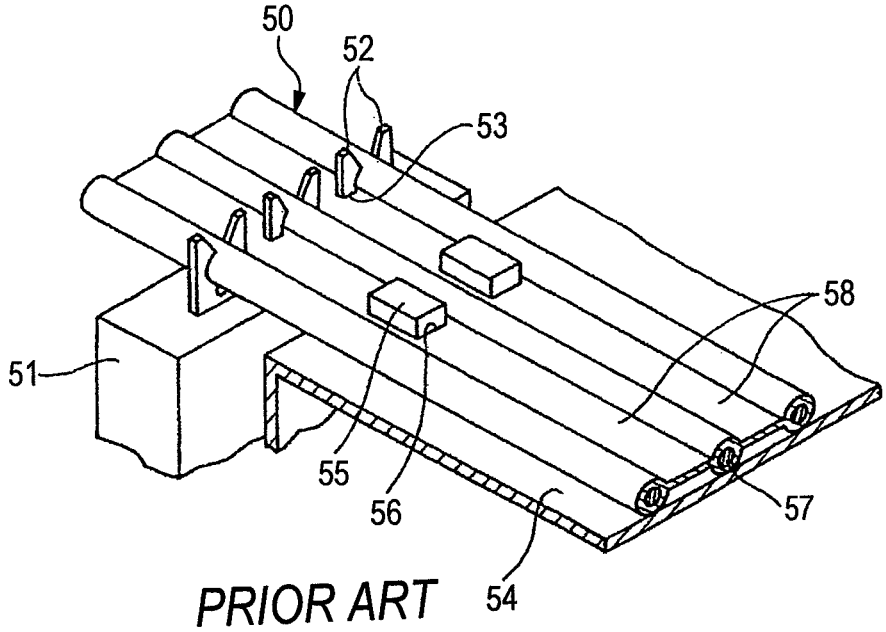
FIG. 8 is a perspective view showing a mode of a flat harness fitting method in the prior art.
Figure 9:
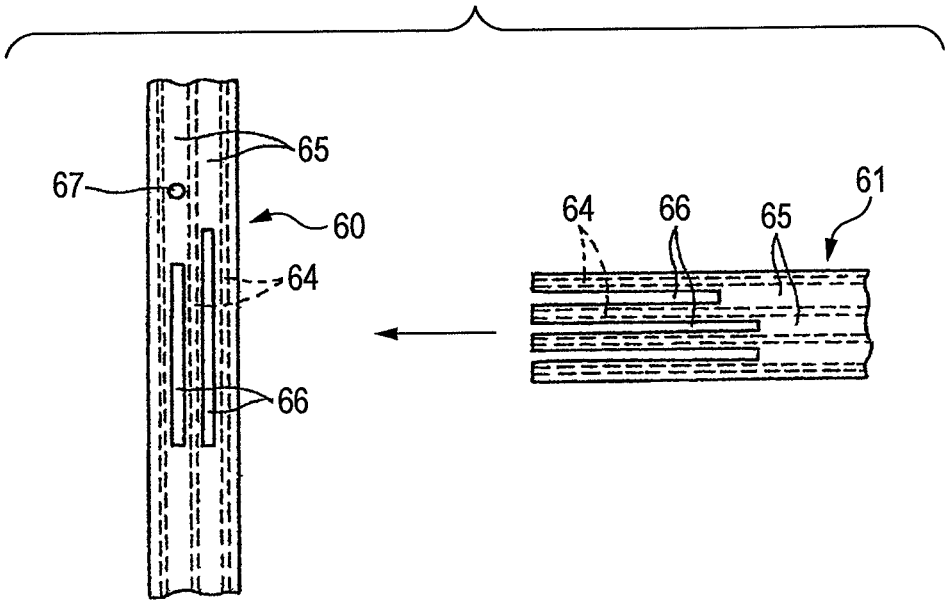
PRIOR ART FIG. 9
FIG. 9 is a plan view showing a mode of a flat harness connector manufacturing method in the prior art.
Figure 10:
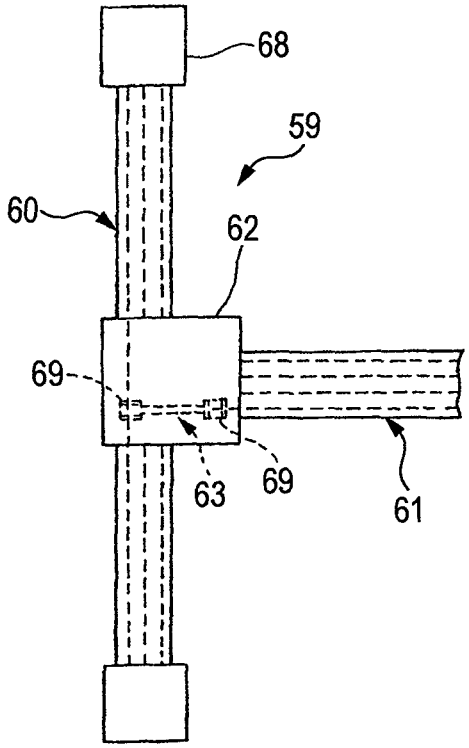
FIG. 10 is a plan view showing the flat harness connector in the prior art.
Figure 11:
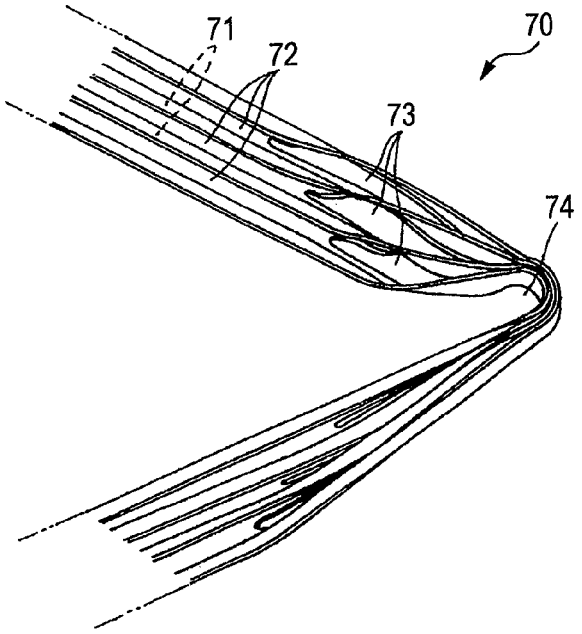
FIG. 11 is a perspective view showing a mode of the flat harness in the prior art.

The longer hole portion 4 is formed by a longitudinal longer punch 9 and a device 12 of a punching machine 8 shown in FIG.5. The circular hole portion 6 is formed by a circular (circular cylinder) punch 10 and a circular device 13 in FIG.5. The shorter hole portion 5 is formed by a rectangular shorter punch 11 and a device 14 in FIG.5. Base plate portions 15, 16 of the dies 12, 14, which are used to process the longer and shorter hole portions 4, 5, may be formed to extend integrally in the longitudinal direction, as indicated with a chain line 17 in FIG.5. It is preferable that the base plate portions 15, 16 should be moved back and forth independently in the longitudinal direction of the harness.

In the punching machine 8 in FIG. 5, the longer punch 9 and the circular punch 10 are provided integrally to the same head 18, and the shorter punch 11 is provided to another head 19. In the first head 18, the circular punch 10 may be moved vertically independently from the longer punch 9.

The longer punch 9 and the circular punch 10 and their corresponding dies 12, 13 constitute a first punching device 21. The shorter punch 11 and the corresponding die 14 constitute a second punching device 22. When respective dice 12 to 14 are formed in the same base plate portion 17, as indicated with a chain line in FIG. 5, the longer punch 9, the circular punch 10, and the common base plate portion 17 constitute the first punching device 21, and the shorter punch 11 and the common base plate portion 17 constitute a second punching device 22.

In FIG.5, the punches 9 to 11 and the dies 12 to 14 are aligned in one row. In this case, the punches 9 to 11 and the dies 12 to 14 may be arranged in plural in parallel or almost parallel with each other in the alignment direction of the conductor portions 2 (displaced slightly in the longitudinal direction of the harness) to correspond to respective coupling plate portions 3 between the conductor portions of the flat harness $\mathbf{1}_1$. It would be preferable to do so because plural holes 4 to 6 having the same shapes can be opened simultaneously.

For convenience of explanation, the flat harness $\mathbf{1}_1$ having three conductor portions 2 is illustrated in FIG.1. Of course, the flat harness having four conductor portions 2 or more can be used. In such case, it is preferable that the punches 9 to 11 and the dies 12 to 14 should be arranged in positions that correspond to respective coupling plate portions 3. The shape of the conductor portion 2 is not limited to a circular section, and a rectangular shape, a flat type, or the like may be set appropriately as occasion demands.

In FIG. 1, the longer hole portions 4 are formed to displace slightly in the longitudinal direction of the harness (to have a level difference $L_1$) respectively, whereby it can be prevented that the flat harness $\mathbf{1}_1$ is fitted to the setting jig in its reversed state. The longer hole portions 4 are formed to have the same length and width. The circular hole portion 6 is provided closely on one end (inner end) side of the longer hole portion $\mathbf{4}_1$ in the first row in parallel with such longer hole portion $\mathbf{4}_1$. An inner diameter of the circular hole portion 6 is set identically to or smaller than an inner width of the longer hole portion $\mathbf{4}_1$. A distance from one end of the longer hole portion $\mathbf{4}_1$ to one end of the circular hole portion 6 is set equal to or smaller than a length of the shorter hole portion $\mathbf{5}_1$.

When the longer hole portion 4 is formed by one longer punch 9 (FIG.5) and the die 12, the longer punch 9 and the die 12 are moved right and left and backward and forward (the longitudinal direction and the width direction of the harness) by a driving means (not shown). The longer hole portion $\mathbf{4}_1$ and the circular hole portion 6 in the first row are formed simultaneously with one stroke of the head 18 (FIG.5), and then the longer hole portion $\mathbf{4}_2$ in the second row can be formed by the longer punch 9 in a state that the circular punch 10 is lifted to be set free, for example. When a plurality of the punches 9 to 11 and the dies 12 to 14 are arranged in every row, the above procedure is not needed. Therefore, the longer hole portion 4 and the circular hole portion 6 in each row can be formed simultaneously with one stroke of the head 18.

The shorter hole portions 5 are formed in parallel away from the longer hole portions 4 in the longitudinal direction of the harness in registration with them. The shorter hole portions 5 are formed to have the same size and shape, and are formed on a prolonged line of the longer hole portion 4 to have the same width dimension (dimension of the short side portion) as the longer hole portion 4.

The shorter hole portions 5 in each row may be formed separately by moving one shorter punch 11 in FIG.5 in the width direction of the harness, or the shorter punch 11 and the die 14 may be arranged in each row and then the shorter hole portions 5 may be formed at the same time. The holes may be opened by not moving the punches 9 to 11 and the dies 12 to 14 but moving the flat harness 1 itself right and left and backward and forward.

Figure 2:
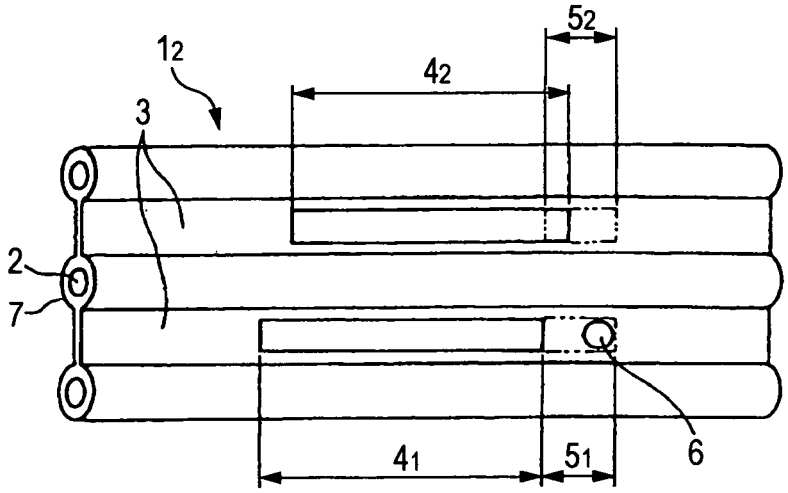
FIG. 2 is a plan view showing an intermediate machining state of the flat harness manufactured by the flat harness machining method.
Figure 3:
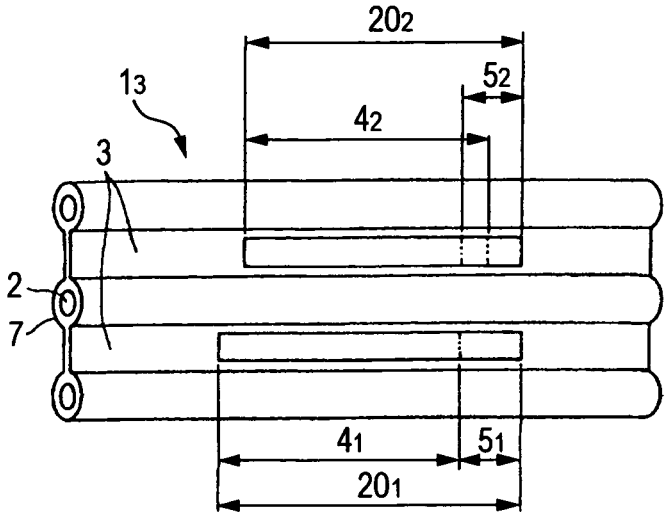
FIG. 3 is a plan view showing a flat harness manufactured by the flat harness machining method according to a second embodiment of the present invention.

FIG. 2 and FIG. 3 show a mode in which longer secondary hole portions 20 are formed by forming the shorter hole portions 5 ($5_1$, $5_2$) to be connected to or lapped over the longer hole portions 4 ($4_1$,$4_2$) of a flat harness $1_2$.

First, as shown in FIG. 2, the longer hole portion 4 is formed in the coupling plate portion (insulating portion) 3 between the conductor portions 2 by the longer punch 9 and the device 12 in FIG. 5 while displacing little by little in the longitudinal direction, like the longer hole portion 41 in FIG. 1. Then, as shown in FIG. 3, the shorter hole portions 5 are formed on one end side of the longer hole portions 4 by the shorter punch 11 and the device 14 in FIG. 5.

Because the shorter hole portion 51 is punched to overlap with the circular hole portion 6, the circular hole portion 6 adjacent to the longer hole portion 41 in the first row is eliminated. Since the circular positioning hole portion 6 is eliminated, such a situation can be eliminated that, for example, when a longer secondary hole portion $20_1$ (FIG. 3) is used to position at a time of the press-fitting, the worker mixes up such circular positioning hole portion 6 with other positioning hole portions 6 and is confused. In particular, since the above confusion is liable to occur when a positioning hole portion such as a rectangle (square or rectangle), or the like is provided instead of the circular hole portion 6, the advantage of eliminating the unnecessary hole portion is great.

Also, since the shorter hole portion $5_2$ is punched to lap over one end portion of the longer hole portion $4_2$ in the second row, one end position of each of the rectangular shorter second hole portions $5_1$, $5_2$ can be aligned without displacement. Since the hole portions $4_2$, $5_2$ are formed to lap mutually, a length of a secondary hole portion $20_2$ in the second row can be defined shorter than the secondary hole portion $20_1$ in the first row. Thus, when longer and shorter ribs of the setting jig of the press-fitting unit, for example, are engaged with the hole portions $20_1$, $20_2$, it can be prevented that a flat harness $1_3$ is fitted in error not only inside out but also front side back. Therefore, the circular hole portion 6 for preventing the front/back reversed fitting is not needed.

In FIG. 3, the longer hole portions 4 and the shorter hole portions 5 are integrated together respectively to constitute two longer secondary hole portions 20 that are longer than the longer hole portions 4 in FIG. 1 and have a different length respectively. When three coupling plate portions 3 or more are present between the conductor portions 2, three longer secondary hole portions 20 or more can be formed by this approach. In this case, the secondary hole portions 20 having a different length sequentially can be formed by changing sequentially a lapping margin between the longer primary hole portion 4 and the corresponding shorter primary hole portion 5.

The longer secondary hole portions 20 are used when the flat harness $1_3$ is bent along the plate width direction, for example. Because the lapping margin between the longer primary hole portion 4 and the corresponding shorter primary hole portion 5 can be changed sequentially, the secondary hole portions 20 can be formed to prolong a length sequentially. The flat harness $1_3$ is bent such that the shorter secondary hole portion $20_2$ side is located on the bending inner side (the longer secondary hole portion 20 is located on the bending outer side). In this case, the secondary hole portion 20 can be used to engage the longer positioning ribs in the press-fitting or insert the press-fitting pieces of a plurality of the press-fitting terminals, for example, except the bending of the flat harness.

The secondary hole portion 20 can be formed, for example, by lifting the middle circular punch 10 to be set free after the primary hole portions 4 are punched by the longer punch 9 in FIG.5, and then moving the shorter punch 11 up to the longer punch 9 and then bringing down the shorter punch 11 while touching the longer punch 9. In that case, the dies 12, 14 are moved together with the punches 9, 11. When the shorter hole portions 5 are caused to lap over the longer primary hole portions 4, the shorter punch 11 is moved toward the longer punch 9 in a condition that the longer punch 9 and the circular punch 10 are moved upward or frontward to be set free. This can be done when the shorter hole portions 5 are not lapped over the longer hole portions 4. The flat harness itself can be moved instead of moving the punches 9, 11.

Figure 4:
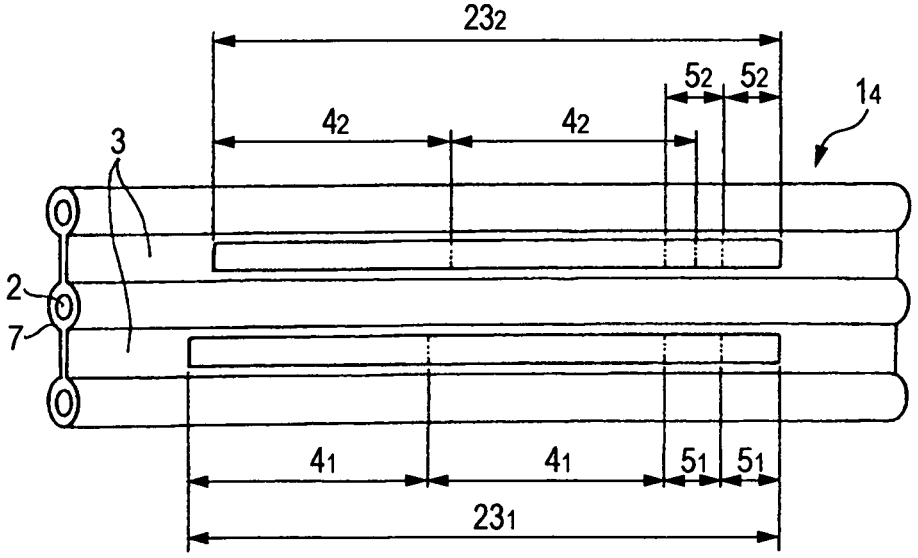
FIG. 4 is a plan view showing a flat harness manufactured by the flat harness machining method according to a third embodiment of the present invention.

FIG. 4 shows a flat harness $1_4$ in which further longer tertiary hole portions 23 are formed by forming further the longer primary hole portions 4 and the shorter primary hole portions 5 in the secondary hole portions 20 of the flat harness $1_3$ in a mode shown in FIG. 3 to be connected to or lapped over them.

In FIG. 4, a longer tertiary hole portion $23_1$ in the first row is formed to have a length obtained when two longer primary hole portions $4_1$ and two shorter primary hole portions $5_1$ are continued linearly. A longer tertiary hole portion $23_2$ in the second row is formed to have a length obtained when a lapping margin between one longer primary hole portion $4_2$ and one shorter primary hole portion $5_2$ is subtracted from the longer tertiary hole portion $23_1$ in the first row.

Two longer hole portions 4 are formed when the longer hole portions 4 are punched by moving the longer punch 9 in FIG.5 up to the other end of the secondary hole portion 20 in FIG.3 and falling down the longer punch 9, and subsequently or precedingly the shorter hole portions 5 are punched by moving the shorter punch 11 in FIG.5 up to one end of the secondary hole portion 20 in FIG.3 and falling down the shorter punch 11. The dies 12, 14 in FIG.5 may be moved simultaneously with the movement of the punches 9, 11, otherwise a long die (not shown) containing a distance within the punches 9, 11 are moved may be formed in advance.

Here, the longer tertiary hole portions 23 in FIG.4 can be formed by forming continuously the longer hole portions 4 and the shorter hole portions 5 in addition to the longer and shorter primary hole portions 4, 5 in FIG.1, for example, instead of the secondary hole portion 20 in FIG.3. In this case, the circular hole portion 6 in FIG.1 is eliminated by punching the longer hole portion 4 to overlap with it. The number of punching times of the longer punch 9 and the shorter punch 11 is not limited to twice, and respective hole portions can be punched in the appropriate number of times according to the necessary length of the hole portions.

Also, the hole portion that is shorter than the longer tertiary hole portion $\mathbf{23}_1$ in the first row in the longitudinal direction may be formed by omitting the punching of the shorter hole portions $\mathbf{5}_2$ on one end side of the longer tertiary hole portion $\mathbf{23}_2$ in the second row in FIG. 4. Also, the longer tertiary hole portion may be formed by forming only one longer hole portion 4 and then causing a plurality of shorter hole portions 5 to be connected to such longer hole portion 4.

A sufficient length can be assured by the longer tertiary hole portion 23 in FIG. 4. For example, the longer hole portion used to bend the flat harness $\mathbf{1}_4$, the longer hole portion engaged with the longer rib of the setting jig at a time of press-fitting, and the longer hole portion through which the press-fitting pieces of plural press-fitting terminals are passed can be formed in a necessary length respectively.

According to the flat harness machining method in FIG.1 to FIG.4, the hole portions 20, 23 having a different length as the case may be can be formed simply without fail by moving the same punches 9, 10. Therefore, a productivity of the flat harness 1 ($\mathbf{1}_1$ to $\mathbf{1}_4$) can be improved and also a size reduction and a cost reduction of the punching machine can be achieved because of a reduction of the punches (punching devices). Also, since another large hole portion 20 is formed by deleting the positioning hole portion used at a time of press-fitting by virtue of the punching, the worker never confuses another hole portion 20 with the positioning hole portion 6. Therefore, the workability in fitting the flat harness 1 to the vehicle, or the like, forexample, can be improved.

In the above embodiments, the hole portions 4 to 6 are punched and formed by using the punching machine 8 equipped with the first punching device 21 and the second punching device 22. But three types or more of hole portions can be punched and formed by using the punching machine equipped with three punching devices or more.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-083760 filed on Mar. 23, 2005, the contents of which are incorporated herein for reference.

What is claimed is:

1. A method of machining a flat harness, the flat harness including at least three conductor portions, which extend in a longitudinal direction and are aligned in parallel, and insulating portions arranged between adjacent conductor portions of the at least three conductor portions, the method comprising:

providing a punching machine that includes a first punching device and a second punching device that are separately provided and independently controllable, the first and second punching devices each including a punch and a die;

punching a first hole portion on each of the insulating portions arranged between the adjacent conductor portions of the at least three conductor portions of the flat harness in a die cutting process by moving one of the punch and the die of the first punching device in a first direction perpendicular to the longitudinal direction; and punching a second hole portion on each of the insulating portions arranged between the adjacent conductor portions of the at least three conductor portions of the flat harness in the die cutting process by moving one of the punch and the die of the second punching device in the first direction;

wherein the method of punching the flat harness is performed by moving at least one of the second punching device and the flat harness in the longitudinal direction and relative to each other between the punching of each first hole portion and the punching of each second hole portion respectively by a predetermined distance in the longitudinal direction, said predetermined distance being variable and selected such that the second punching device is at a position relative to the flat harness so that the punch of the second punching device is aligned to overlap or abut each respective first hole portion, wherein the punching of each second hole portion forms a third hole portion on each of the insulating portions, each third hole portion having a length larger than that of the respective first hole portion on each respective insulating portion of the flat harness, and wherein the punching of the first hole portion on one of the insulating portions is displaced by a level difference in the longitudinal direction from the punching of the first hole portion on another one of the insulating portions such that a distal end of the third hole portion formed by the first hole portion on said one of said insulating portions is displaced in the longitudinal direction relative to a distal end of the third hole portion formed on said another one of the insulating portions.

2. The method according to claim 1, wherein for punching one of the first hole portions, the punch of the first punching device is a first punch, and the first punching device further comprises a second punch that is differently shaped relative to the first punch; and wherein the punching of the one first hole portion is performed by the first punch of the first punching device, and further comprising punching a fourth hole portion using the second punch of the first punching device, wherein the punching of the one first hole portion and the punching of the fourth hole portion are performed simultaneously by the first punching device in the die cutting process.

3. The method according to claim 2, wherein the predetermined distance is selected such that the position of the second punching device is selected so that the punch of the second punching device is aligned to overlap the fourth hole portion to form the third hole portion.

4. The method according to claim 3, wherein a width of the fourth hole portion is less than or equal to a width of the corresponding second hole portion.

5. The method according to claim 2, wherein the one first hole portion has a near end distal to the fourth hole portion and a far end proximal to the fourth hole portion, and wherein the fourth hole portion is spaced from the far end of the one first hole portion, and a distance from the far end of the one first hole portion to a far end of the fourth hole portion is less than or equal to a length of the punch of the second punching die;

whereby the fourth hole portion is eliminated as a result of punching of the corresponding second hole portion.

6. The method according to claim 1, wherein the position of the second punching device is selected so that the punch of the second punching device is aligned to overlap the respective first hole portion.

* * * * *